US012722820B2

(12) United States Patent
Hashimoto et al.

(10) Patent No.: US 12,722,820 B2
(45) Date of Patent: Sep. 1, 2026

(54) FORMER, BAGMAKING AND PACKAGING MACHINE, AND METHOD OF MANUFACTURING BAGMAKING AND PACKAGING MACHINE

(71) Applicant: ISHIDA CO., LTD., Kyoto (JP)

(72) Inventors: Satoshi Hashimoto, Ritto (JP); Makoto Ichikawa, Ritto (JP); Rintaro Moritani, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 71 days.

(21) Appl. No.: 18/319,494

(22) Filed: May 18, 2023

(65) Prior Publication Data

US 2023/0382576 A1 Nov. 30, 2023

(30) Foreign Application Priority Data

May 26, 2022 (JP) ..... 2022-086167

(51) Int. Cl.
*B65B 9/08* (2012.01)
*B65B 9/20* (2012.01)
(Continued)

(52) U.S. Cl.
CPC ..... *B65B 9/08* (2013.01); *B65B 9/20* (2013.01); *B65B 9/2028* (2013.01); *B65B 9/22* (2013.01);
(Continued)

(58) Field of Classification Search
CPC B65B 9/08; B65B 9/20; B65B 9/2028; B65B 9/22; B65B 39/007; B65B 41/12;
(Continued)

(56) References Cited

U.S. PATENT DOCUMENTS 3,486,424 A 12/1969 Tanner
4,144,693 A * 3/1979 Ogata ..... B65B 37/18 53/433
(Continued)

FOREIGN PATENT DOCUMENTS

JP 2008230621 A 10/2008
JP 2012-086874 A 5/2021
JP 2021-095158 A 6/2021

OTHER PUBLICATIONS

The Search Report from the corresponding European Patent Application No. 23175300.5 issued on Dec. 12, 2023.
(Continued)

*Primary Examiner* — Robert F Long
*Assistant Examiner* — Eduardo R Ferrero
(74) *Attorney, Agent, or Firm* — United IP Counselors, LLC

(57) ABSTRACT

A bagmaking and packaging machine forms a packaging material in a tubular shape and packages packaging articles. The bagmaking and packaging machine includes a former, a wraparound member, and a support member. The former folds and guides the packaging material. Around the wraparound member is wrapped the packaging material folded by the former. The support member supports the former and the wraparound member. The former includes a collar member that guides the packaging material and a first tube member for forming in a tubular shape the packaging material guided by the collar member. The first tube member has one end to which the collar member is connected, and includes a first mating portion that is mated with the support member.

1 Claim, 11 Drawing Sheets

A–A'

(51) Int. Cl.

| | |
|---|---|
| ***B65B 9/22*** | (2006.01) |
| ***B65B 39/00*** | (2006.01) |
| ***B65B 41/12*** | (2006.01) |
| ***B65B 51/26*** | (2006.01) |
| ***B65B 51/30*** | (2006.01) |
| ***B65B 59/04*** | (2006.01) |
| ***B65B 61/06*** | (2006.01) |

(52) U.S. Cl.
CPC ..... *B65B 39/007* (2013.01); *B65B 51/26* (2013.01); *B65B 51/30* (2013.01); *B65B 59/04* (2013.01); *B65B 61/06* (2013.01); *B65B 41/12* (2013.01)

(58) Field of Classification Search
CPC ..... B65B 51/26; B65B 51/30; B65B 59/04; B65B 61/06
See application file for complete search history.

(56) References Cited

U.S. PATENT DOCUMENTS 5,707,329 A 1/1998 Pool et al.
5,816,018 A * 10/1998 Bois ..... B65B 9/20 53/139.2
5,826,401 A * 10/1998 Bois ..... B65B 41/16 53/139.2
5,845,465 A * 12/1998 Bennett ..... B29C 66/112 53/374.3
5,852,919 A * 12/1998 Matsuda ..... B65B 61/28 53/551
5,870,887 A * 2/1999 Bennett ..... B65B 65/04 53/551
5,983,610 A * 11/1999 Fukuda ..... B65B 9/20 53/551
6,131,367 A * 10/2000 Fukuda ..... B65B 59/04 53/551
6,131,374 A * 10/2000 Bois ..... B65B 9/20 53/139.2
6,314,706 B1 * 11/2001 Araki ..... G01G 23/38 53/551
6,523,325 B1 2/2003 Forman et al.
7,003,929 B2 * 2/2006 Laplace ..... B65B 9/22 53/551
7,523,597 B2 * 4/2009 Dominguez, Jr. ..... B65B 9/22 493/308
2003/0097827 A1 * 5/2003 Bussey, Jr. ..... B65B 9/2021 53/551
2004/0014576 A1 * 1/2004 Bois ..... B65B 61/188 493/114
2010/0037568 A1 * 2/2010 Hashimoto ..... B65B 9/22 53/551
2011/0107729 A1 * 5/2011 Miyazaki ..... B29C 66/81431 53/562
2012/0145516 A1 * 6/2012 Tokuda ..... B65B 9/20 198/533
2012/0225763 A1 * 9/2012 Shimoda ..... B65B 9/22 493/243

OTHER PUBLICATIONS

Jan. 29, 2026; The Second Office Action, Application No. 202310450877.x, issued in the corresponding Chinese Patent Application; 8 Pages.
Appendix—Comparison of Present Application and Cited Publications; 22 Pages.
Japan Patent Office, Information Statement for Japanese Patent Application JP2022-86167; May 14, 2026; 4 Pages.

* cited by examiner

A–A'

FORMER, BAGMAKING AND PACKAGING MACHINE, AND METHOD OF MANUFACTURING BAGMAKING AND PACKAGING MACHINE

CROSS-REFERENCE TO RELATED APPLICATIONS

This application is based on and claims the priority benefit of Japanese patent application 2022-086167 filed May 26, 2022, the contents of which are incorporated herein by reference.

TECHNICAL FIELD

The present invention relates to a former, a bagmaking and packaging machine, and a method of manufacturing a bagmaking and packaging machine.

BACKGROUND

Patent Literature 1 (Japanese Patent Unexamined Publication No. 2012-86874A) discloses a former where a collar member (a sailor collar member) is connected to one end of a tube member. The former is used in a bagmaking and packaging machine together with a wraparound member around which a packaging material folded by the former is wrapped.

SUMMARY OF THE INVENTION

In a bagmaking and packaging machine, the packaging material folded by the former needs to be formed in a cylindrical shape by the wraparound member without causing the packaging material to crease or become crooked. For this reason, high-precision positioning is required to assemble the former and the wraparound member. In assembling the former and the wraparound member, work is performed to secure the former and the wraparound member to a support member using welding or screws, for example, and thereafter to adjust their positions. Such assembly work including position adjustment is complicated.

It is an object of the present invention to provide a former that is positioned with high precision by simple assembly work, a bagmaking and packaging machine using the former, and a method of manufacturing the bagmaking and packaging machine.

A former according to a first aspect folds and guides a packaging material. The former includes a collar member that guides the packaging material and a first tube member for forming in a tubular shape the packaging material guided by the collar member. The first tube member has one end to which the collar member is connected, and includes a first mating portion.

A bagmaking and packaging machine according to a second aspect forms a packaging material in a tubular shape and packages packaging articles. The bagmaking and packaging machine includes the aforementioned former, a wraparound member, and a support member. Around the wraparound member is wrapped the packaging material folded by the former. The support member supports the former and the wraparound member.

The first mating portion is mated with the support member.

In this bagmaking and packaging machine, the former is positioned on the support member by mating. Consequently, by the use of this bagmaking and packaging machine, the former is positioned with high precision by simple assembly work.

A bagmaking and packaging machine according to a third aspect is the bagmaking and packaging machine of the second aspect, wherein the wraparound member includes a second tube member and a chute. The second tube member is a tubular member around which the packaging material is wrapped. The chute is a member that guides the packaging articles to the second tube member.

The chute is connected to one end of the second tube member and includes a second mating portion that is mated with the support member.

In this bagmaking and packaging machine, the wraparound member is positioned on the support member by mating. Consequently, by the use of this bagmaking and packaging machine, the former and the wraparound member are positioned with high precision by simple assembly work.

A bagmaking and packaging machine according to a fourth aspect is the bagmaking and packaging machine of the third aspect, wherein the support member includes a first support member and a second support member. The first support member supports the former. The second support member supports the wraparound member.

In the first support member is formed a first mating hole with which the first mating portion is mated. In the second support member is formed a second mating hole with which the second mating portion is mated.

A central axis of the first mating hole coincides with a central axis of the second mating hole.

In this bagmaking and packaging machine, the central axis of the first mating hole coincides with the central axis of the second mating hole. For this reason, the former and the wraparound member are mutually positioned as a result of the first mating portion being mated with the first mating hole and the second mating portion being mated with the second mating hole. Consequently, by the use of this bagmaking and packaging machine, the former and the wraparound member are positioned with high precision by simple assembly work.

A bagmaking and packaging machine according to a fifth aspect is any of the bagmaking and packaging machines of the second aspect to the fourth aspect, wherein a cutout portion of the first tube member to which is connected an edge of the collar member is formed across the circumferential direction in a surface on the one end side of the first tube member.

In this bagmaking and packaging machine, the collar member is positioned by bringing the edge, which defines a notch, into abutment with the cutout portion. Consequently, by the use of this bagmaking and packaging machine, the collar member is positioned on the first tube member with high precision.

A bagmaking and packaging machine according to a sixth aspect is the bagmaking and packaging machine of the fifth aspect, wherein a depth of the cutout portion is greater than a plate thickness of the collar member.

In this bagmaking and packaging machine, the depth of the cutout portion is formed greater than the plate thickness of the collar member, so an upper end surface of the first tube member is not even with the surface of the collar member. The upper end surface that is not even with the surface of the collar member can make contact with the packaging material that has slightly separated from the surface of the collar member, so the packaging material can be normally folded at the upper end of the first tube member. Consequently, by the use of this bagmaking and packaging machine, the occurrence of problems in the folding of the packaging material at the upper end of the first tube member is inhibited.

A method of manufacturing a bagmaking and packaging machine according to a seventh aspect is a method of manufacturing any of the bagmaking and packaging machines of the second aspect to the sixth aspect, including a step of connecting the collar member and the first tube member to each other and thereafter forming the first mating portion using cutting.

In this method of manufacturing the bagmaking and packaging machine, the first mating portion is formed with high precision using cutting, so the former is positioned on the support member with high precision.

A method of manufacturing a bagmaking and packaging machine according to an eighth aspect is a method of manufacturing the bagmaking and packaging machine of the third aspect or the fourth aspect, including a step of forming the second mating portion using cutting.

In this method of manufacturing the bagmaking and packaging machine, the second mating portion is formed with high precision using cutting, so the wraparound member is positioned on the support member with high precision.

A method of manufacturing a bagmaking and packaging machine according to a ninth aspect is a method of manufacturing the bagmaking and packaging machine of the third aspect or the fourth aspect, wherein the bagmaking and packaging machine further includes pull-down belts that convey the packaging material along a length direction of the second tube member. The method of manufacturing the bagmaking and packaging machine includes a step of connecting the second tube member and the chute to each other and thereafter forming first surfaces that oppose the pull-down belts in an outer peripheral surface of the second tube member using cutting.

In this method of manufacturing the bagmaking and packaging machine, the first surfaces are formed with high precision using cutting.

A method of manufacturing a bagmaking and packaging machine according to a tenth aspect is a method of manufacturing the bagmaking and packaging machine of the third aspect or the fourth aspect, wherein the bagmaking and packaging machine further includes a longitudinal sealing mechanism that seals edges of the packaging material along a length direction of the second tube member. The method of manufacturing the bagmaking and packaging machine includes a step of connecting the second tube member and the chute to each other and thereafter forming a second surface that opposes the longitudinal sealing mechanism in an outer peripheral surface of the second tube member using cutting.

In this method of manufacturing the bagmaking and packaging machine, the second surface is formed with high precision using cutting.

A method of manufacturing a bagmaking and packaging machine according to an eleventh aspect is a method of manufacturing the bagmaking and packaging machine of the fifth aspect or the sixth aspect, including a step of forming the cutout portion using cutting.

In this method of manufacturing the bagmaking and packaging machine, the cutout portion is formed with high precision using cutting. For this reason, deformation is inhibited from occurring in the edge of the collar member during connection to the cutout portion.

By the use of the bagmaking and packaging machine, the former is positioned with high precision by simple assembly work. Furthermore, by the use of the method of manufacturing the bagmaking and packaging machine, the former is positioned on the support member with high precision.

DESCRIPTION OF EMBODIMENTS

Figure 1:
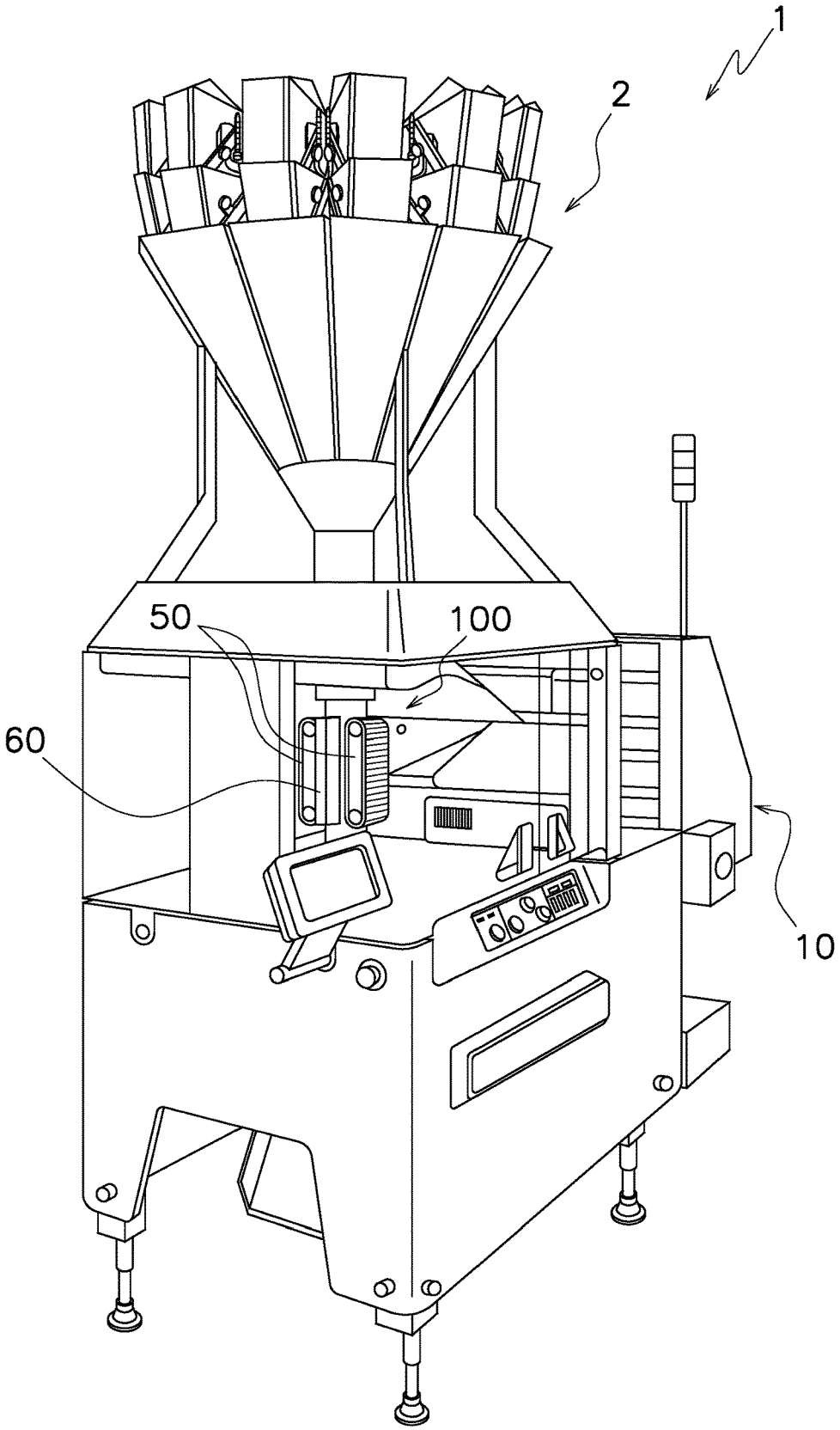
FIG. 1 is a perspective view of an embodiment of a packaging machine including a bagmaking and packaging machine.

A bagmaking and packaging machine 100 and a former 20 according to an embodiment of the present invention will be described below. In the following description, the directions of up/down, right/left, and front/rear are defined as indicated by the arrows in the drawings.

(1) Overview

Figure 2:
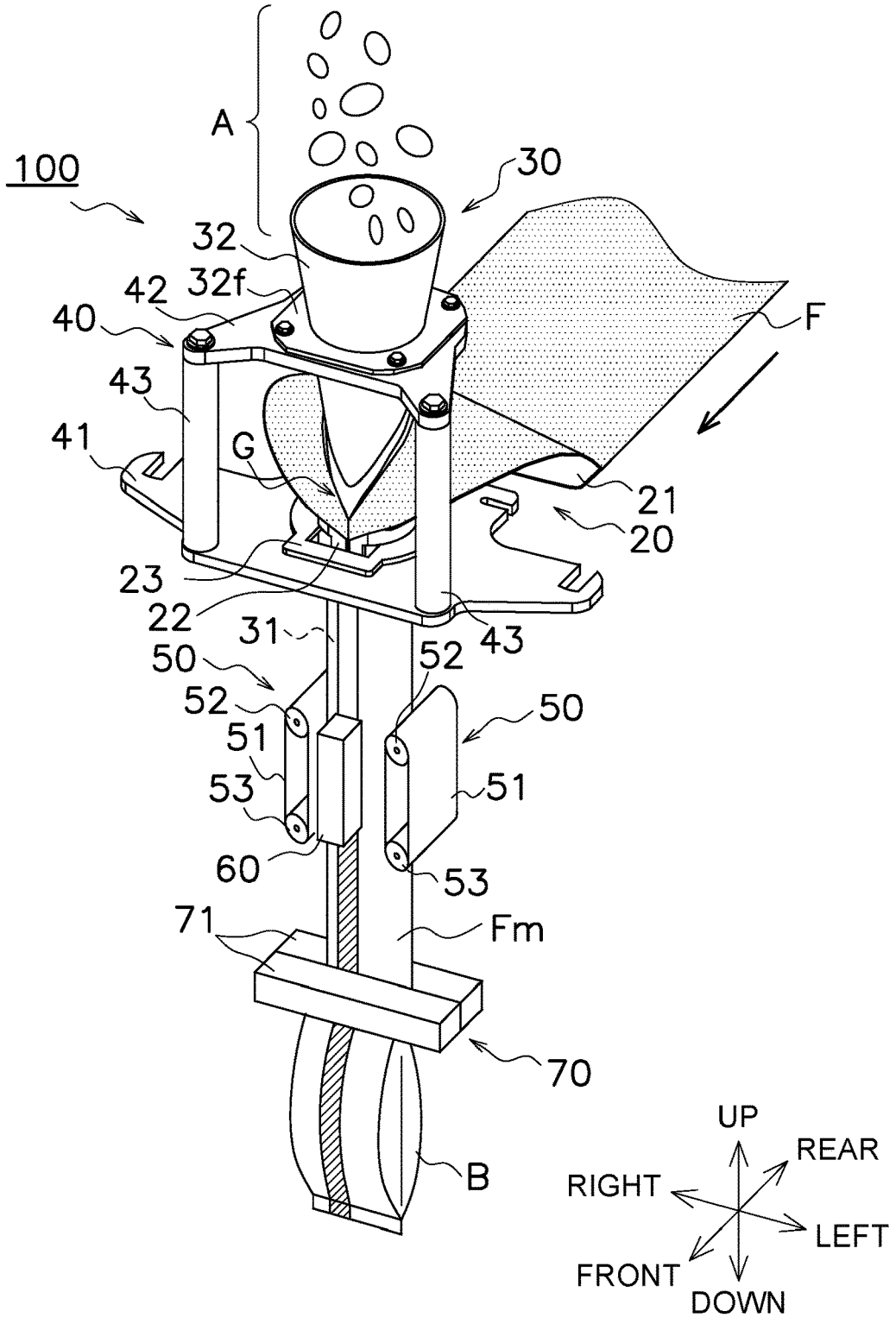
FIG. 2 is a perspective view showing the schematic configuration of the bagmaking and packaging machine during operation.

FIG. 1 is a perspective view of a packaging machine 1 including the bagmaking and packaging machine 100. FIG. 2 is a perspective view showing the schematic configuration of the bagmaking and packaging machine 100. The packaging machine 1 mainly includes a weighing machine 2 and the bagmaking and packaging machine 100.

The weighing machine 2 weighs packaging articles A (i.e., articles that are to be packaged) put into bags B formed by the bagmaking and packaging machine 100 and drops the packaging articles A toward the bagmaking and packaging machine 100. The packaging articles A are not particularly limited; here, they are articles that are light in weight and large in size, such as potato chips. The bagmaking and packaging machine 100 receives the packaging articles A dropping from the weighing machine 2 and packages them in a packaging material F formed in a tubular shape (hereinafter also called a tubular packaging material Fm) to make the bags B. The bagmaking and packaging machine 100 is disposed below the weighing machine 2. The packaging material F is a film using resin as raw material.

The bagmaking and packaging machine 100 mainly includes a packaging material supply unit 10, the former 20, a wraparound member 30, a support member 40, two pull-down belt mechanisms 50, a longitudinal sealing mechanism 60, and a transverse sealing mechanism 70.

(2) Detailed Configuration (2-1) Packaging Material Supply Unit

The packaging material supply unit 10 is a unit that supplies the sheet-like packaging material F to the former 20. The packaging material supply unit 10 pays out the packaging material F from a roll set in the packaging material supply unit 10 and supplies the packaging material F to the former 20. The packaging material F is a film made of resin.

(2-2) Former

Figure 3:
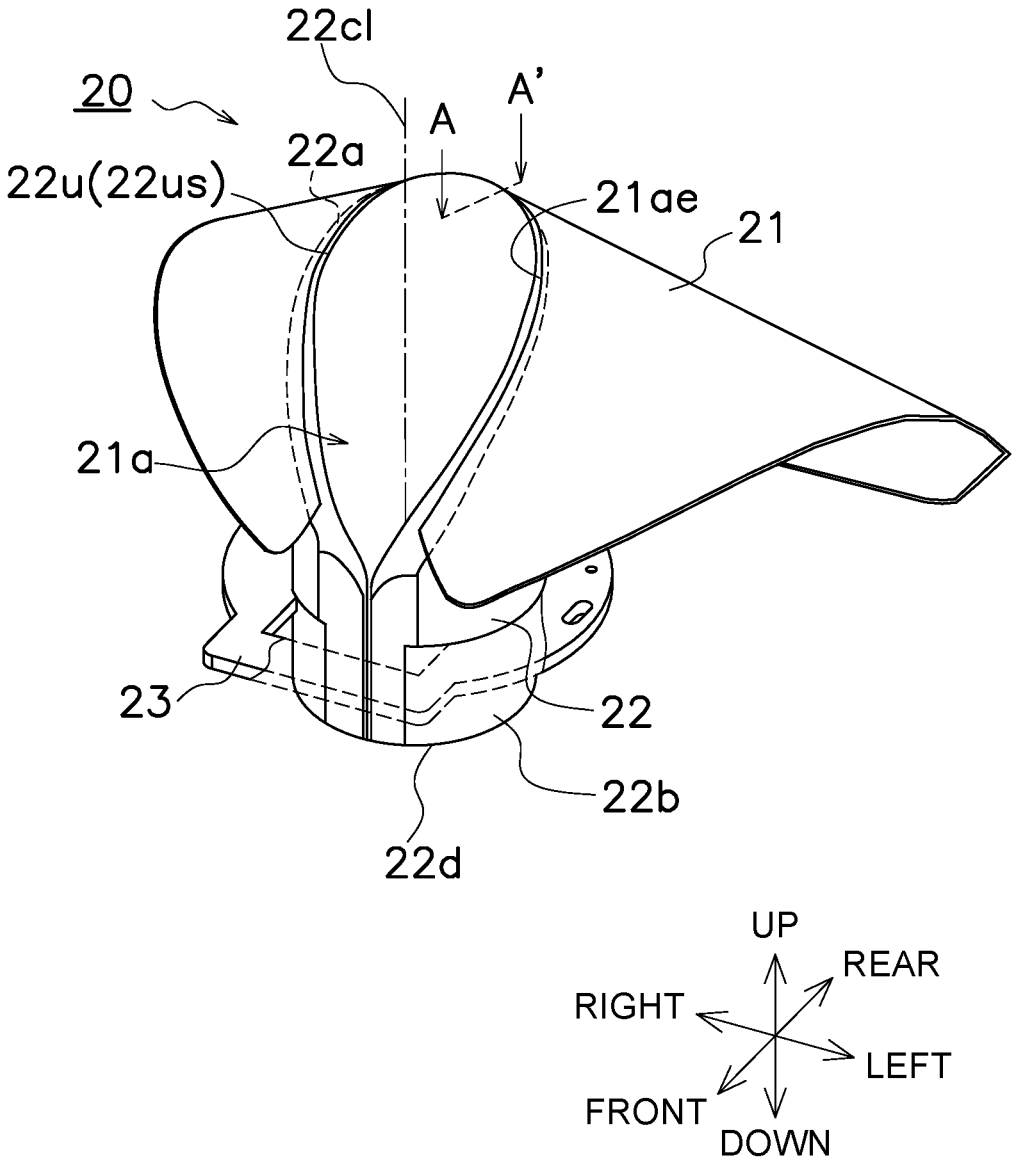
FIG. 3 is a perspective view of a former.
Figure 4:
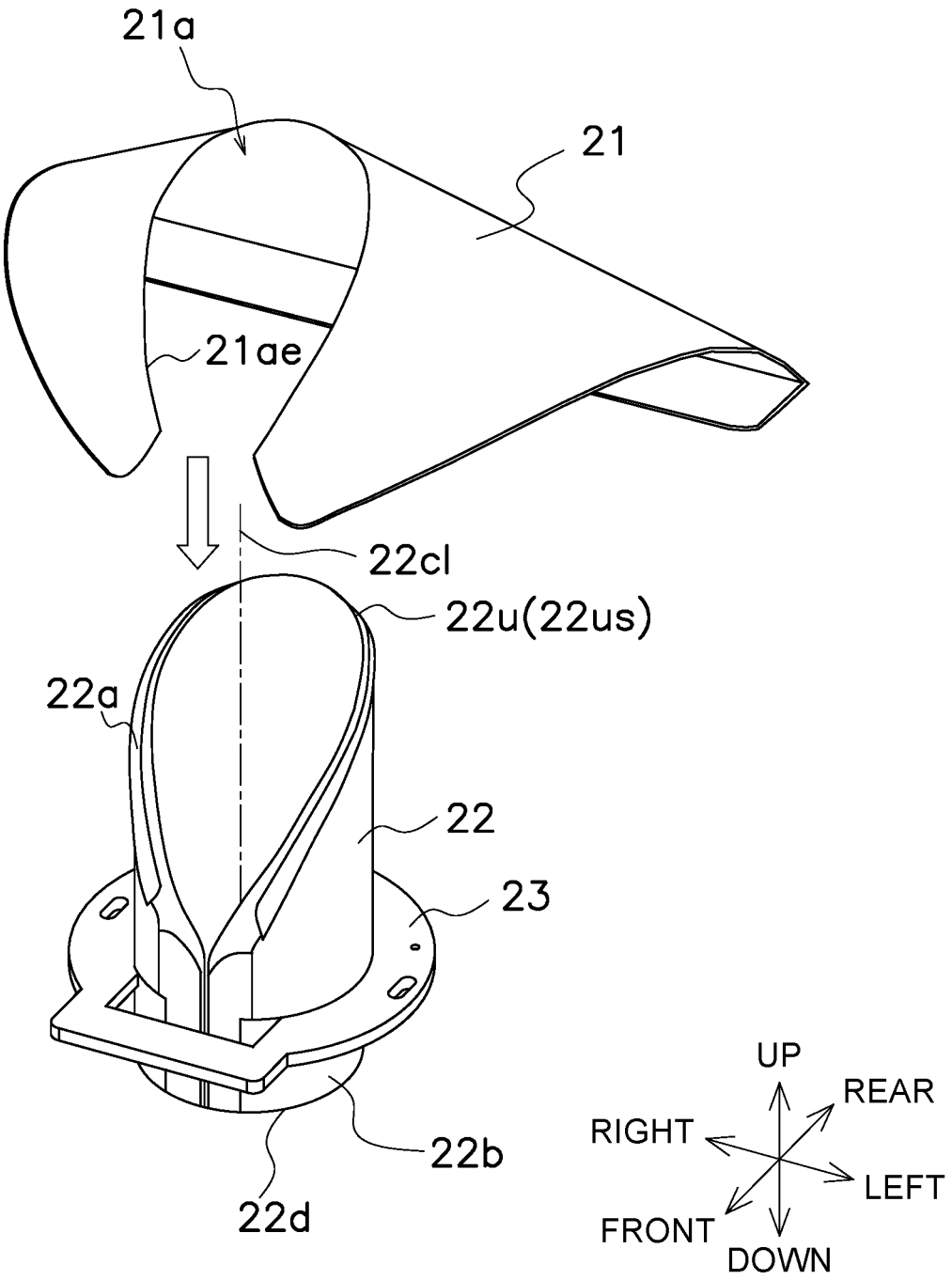
FIG. 4 is a perspective view showing a method of manufacturing the former.

FIG. 3 is a perspective view of the former 20. FIG. 4 is a perspective view showing a method of manufacturing the former 20. The former 20 is a forming mechanism that folds and guides the sheet-like packaging material F supplied from the packaging material supply unit 10. The former 20 mainly includes a collar member 21, a first tube member 22, and a first flange 23. It will be noted that FIG. 3 shows the first flange 23 partially transparent (i.e., illustrated via broken lines) for clarity.

(2-2-1) Collar Member

The collar member 21 is a tabular member that guides, along its surface toward the inner periphery of the first tube member 22, the packaging material F conveyed by the pull-down belt mechanisms 50. In the collar member 21 is formed a U-shaped notch 21*a* connected to an upper end surface 22*us* of the first tube member 22. The collar member 21 is mainly formed in the shape of shoulders heading downward and outwardly away from the notch 21*a* in order to fold the sheet-like packaging material F toward the first tube member 22.

(2-2-2) First Tube Member

The first tube member 22 is a substantially cylindrical member that forms in a tubular shape the packaging material F guided by the collar member 21 and guides the packaging material F to the outer periphery of the wraparound member 30. In the first tube member 22 are mainly formed a cutout portion 22*a* and a first mating portion 22*b*.

Figure 5:
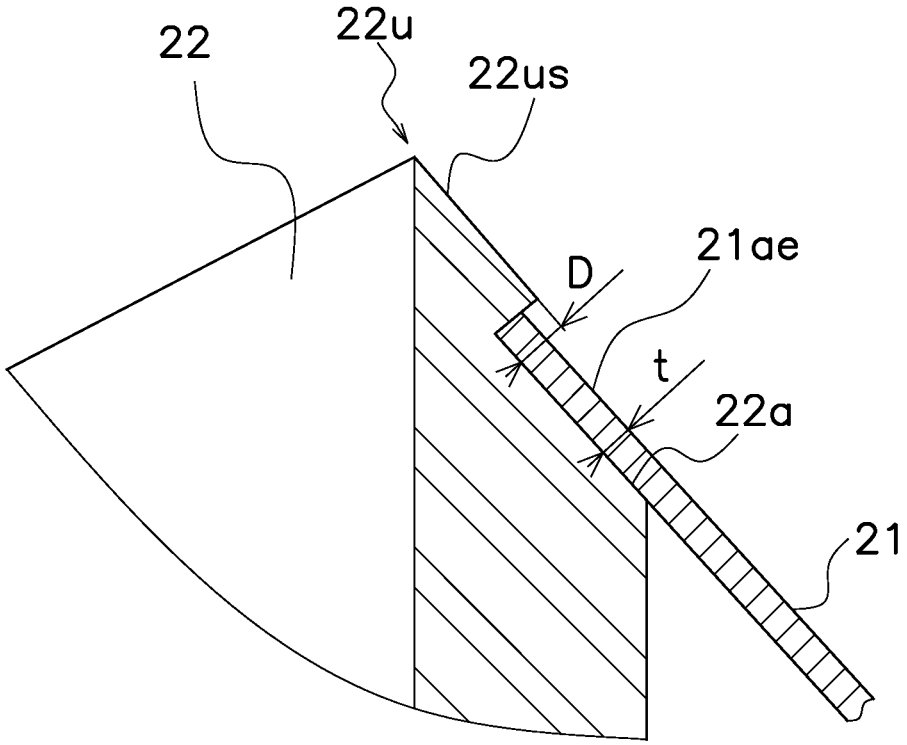
FIG. 5 is a sectional view of the former taken along line A-A' of FIG. 3.

The cutout portion 22*a* is a portion to which is connected an edge 21*ae* of the collar member 21 defining the notch 21*a*. The cutout portion 22*a* is formed in the upper end surface 22*us* of the first tube member 22. An upper end 22*u* of the first tube member 22 is formed in a curve that traces the shape of a drop of water when viewed along the up and down direction. In the present embodiment, the upper end surface 22*us* is a flat surface formed parallel to the surface of the edge 21*ae* of the collar member 21. In other words, the upper end surface 22*us* is a flat surface formed in such a way that, starting at the upper end 22*u*, it heads downward and away along the radial direction from a central axis 22*c*1 of the first tube member 22. The cutout portion 22*a* is formed across the circumferential direction in the upper end surface 22*us*. FIG. 5 is a sectional view showing the shape of the cutout portion 22*a*. FIG. 5 is a sectional view of the former 20 taken along line A-A' of FIG. 3. As shown in FIG. 5, a depth D of the cutout portion 22*a* from the upper end surface 22*us* of the first tube member 22 is formed greater than a plate thickness t of the collar member 21. The upper end surface 22*us* is an example of a surface on one end side of the first tube member 22.

The cutout portion 22*a* is formed using cutting. More specifically, the cutout portion 22*a* is formed using milling. The edge 21*ae* and the cutout portion 22*a* are connected to each other using welding.

The first mating portion 22*b* is a portion that is mated with the support member 40. The first mating portion 22*b* is a cylindrical portion formed across a predetermined width upward from a lower end 22*d* of the first tube member 22. The first mating portion 22*b* is formed in such a way that its outer periphery is in a mating relationship (in the present embodiment, a clearance fit) with the inner periphery of a first mating hole 41*h* (described later) formed in the support member 40. The first mating portion 22*b* is formed in such a way that its central axis coincides with the central axis 22*c*1 of the first tube member 22.

The first mating portion 22*b* is formed using cutting after the collar member 21 and the first tube member 22 have been connected to each other. More specifically, the first mating portion 22*b* is formed using a lathe by rotating the collar member 21 and the first tube member 22 about the central axis 22*c*1 after the collar member 21 and the first tube member 22 have been connected to each other.

(2-2-3) First Flange

The first flange 23 is a flange that secures the former 20 to a first support member 41. The first flange 23 is provided on the outer peripheral surface of the first tube member 22 below the upper end 22*u* and above the first mating portion 22*b*.

The first flange 23 and the first tube member 22 are secured to each other using welding. The first flange 23 is secured using bolts to the first support member 41.

(2-3) Wraparound Member

Figure 6:
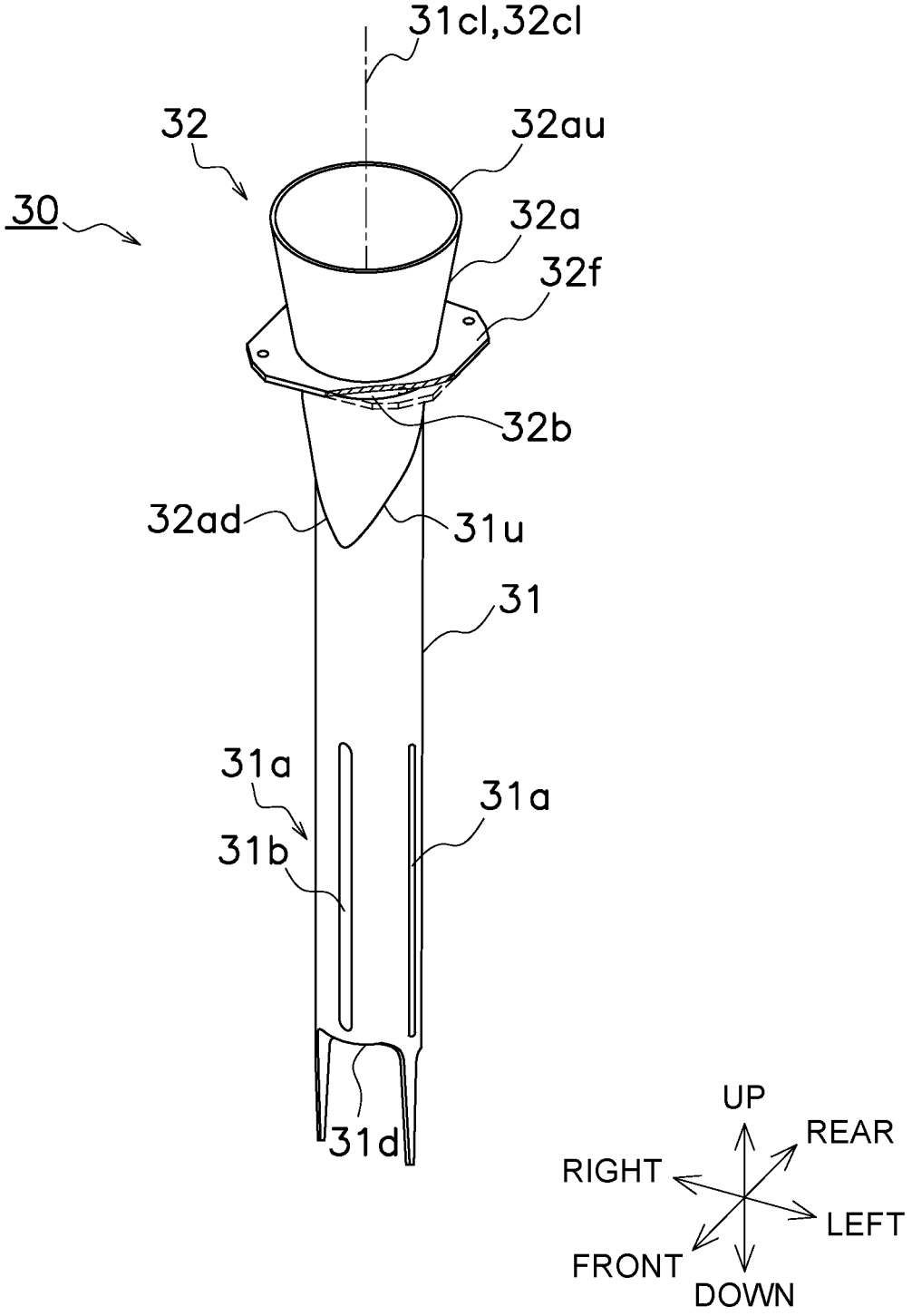
FIG. 6 is a perspective view of a wraparound member.

FIG. 6 is a perspective view of the wraparound member 30. Around the outer periphery of the wraparound member 30 is wrapped the packaging material F folded by the former 20. The packaging material F wrapped around the wraparound member 30 becomes the tubular packaging material Fm as a result of a longitudinal seal (described later) being formed therein. The wraparound member 30 mainly includes a second tube member 31 and a chute 32. It will be noted that FIG. 6 shows a second flange 32*f* (described later) partially transparent (i.e., shown in broken lines) for clarity.

(2-3-1) Second Tube Member

The second tube member 31 is a substantially cylindrical member around whose outer periphery the packaging material F is wrapped. The second tube member 31 has an upper end 31*u* connected to a lower end 32*ad* (described later) of the chute 32. The outer circumference of the second tube member 31 is formed smaller than the inner circumference of the first tube member 22.

In the outer peripheral surface of the second tube member 31 are formed two first surfaces 31*a* and a second surface 31*b*. The first surfaces 31*a* and the second surface 31*b* are both areas formed as flat surfaces. The first surfaces 31*a* are formed so as to oppose pull-down belts 51 across the packaging material F. The second surface 31*b* is formed so as to oppose the longitudinal sealing mechanism 60 across the packaging material F.

The first surfaces 31*a* are formed using cutting after the second tube member 31 and the chute 32 have been connected to each other. Likewise, the second surface 31*b* is formed using cutting after the second tube member 31 and the chute 32 have been connected to each other. More specifically, the first surfaces 31*a* and the second surface 31*b* are formed using milling.

(2-3-2) Chute

The chute 32 is a member that receives the packaging articles A dropping from the weighing machine 2 and guides them to the second tube member 31. The chute 32 mainly includes a funnel member 32*a*, a second mating portion 32*b*, and a second flange 32*f*

The funnel member 32*a* is a funnel-shaped member whose inner diameter becomes smaller from above to below. The funnel member 32*a* is disposed in such a way that its central axis 32*c*1 coincides with a central axis 31*c*1 of the second tube member 31. The funnel member 32*a* has an upper end 32*au* in which is formed an opening that receives the packaging articles A. The funnel member 32*a* has a lower end 32*ad* in which is formed an opening that is connected to the upper end of the second tube member 31.

Hereinafter, the central axis 32$c$1 and the central axis 31$c$1 will be collectively called the central axes 31$c$1, 32$c$1.

Figure 7:
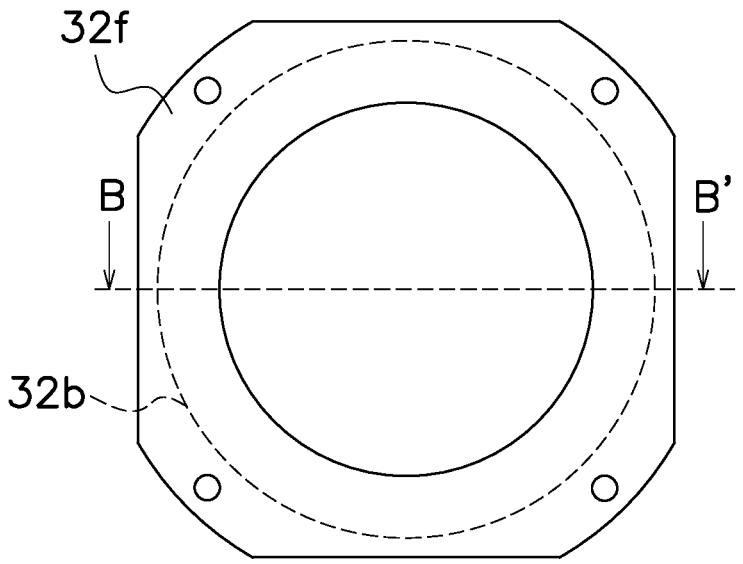
FIG. 7 is a plan view of a second flange.
Figure 8:
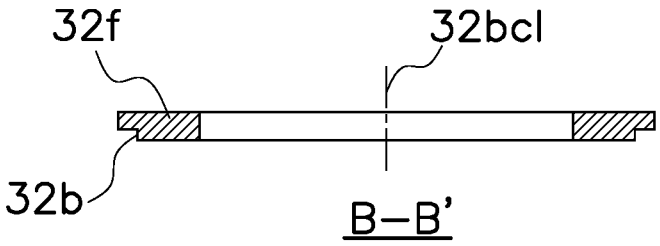
FIG. 8 is a sectional view of the second flange taken along line B-B' of FIG. 7.

The second flange 32$f$ is a flange that secures the wraparound member 30 to a second support member 42. FIG. 7 is a plan view of the second flange 32$f$ FIG. 8 is a sectional view of the second flange 32$f$ taken along line B-B' of FIG. 7. The second flange 32$f$ is provided on the outer peripheral surface of the funnel member 32$a$ below the upper end 32$au$ of the funnel member 32$a$ and above the lower end 32$ad$.

The second flange 32$f$ and the funnel member 32$a$ are secured to each other using welding. The second flange 32$f$ is secured using bolts to the second support member 42.

The second mating portion 32$b$ is a portion that is mated with the support member 40. The second mating portion 32$b$ is a cylindrical portion that projects downward from the lower surface of the second flange 32$f$. The second mating portion 32$b$ is formed in such a way that its outer periphery is in a mating relationship (in the present embodiment, a clearance fit) with the inner periphery of a second mating hole 42$h$ (described later).

The second mating portion 32$b$ is formed using cutting after the second tube member 31 and the funnel member 32$a$, having the second flange 32$f$ secured to it, have been connected to each other. More specifically, the second mating portion 32$b$ is formed using a lathe by rotating the second tube member 31 and the funnel member 32$a$, having the second flange 32$f$ secured to it, about the central axes 31$d$, 32$c$1 after the second tube member 31 and the funnel member 32$a$, having the second flange 32$f$ secured to it, have been connected to each other.

(2-4) Support Member

Figure 9:
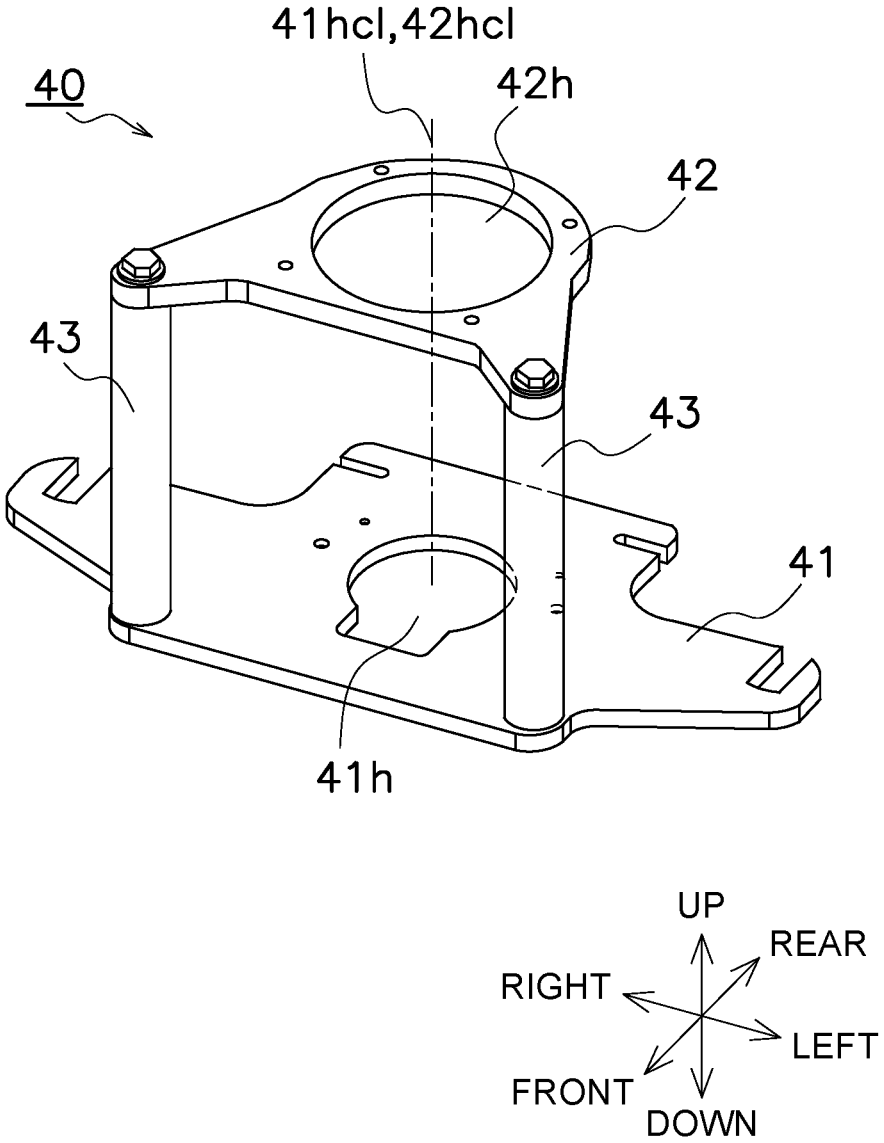
FIG. 9 is a perspective view of a support member.

FIG. 9 is a perspective view of the support member 40. The support member 40 is a member that supports the former 20 and the wraparound member 30. The support member includes a first support member 41, a second support member 42, and two columnar members 43 (one of which is shown partially transparent (i.e., shown in broken lines) for clarity). The support member 40 is secured to a housing (not shown in the drawings) that houses the bag-making and packaging machine 100.

(2-4-1) First Support Member

The first support member 41 is a member that supports the former 20. The first support member 41 supports the former 20 in such a way that the central axis 22$cl$ of the first tube member 22 lies along the up and down direction. In the present embodiment, the first support member 41 is a tabular member. In the first support member 41 is formed a circular first mating hole 41$h$, i.e., a through-hole, into which the first mating portion 22$b$ of the first tube member 22 is inserted. The first mating hole 41$h$ is formed in such a way that its inner periphery is in a mating relationship with the first mating portion 22$b$.

(2-4-2) Second Support Member

The second support member 42 is a member that supports the wraparound member 30. The second support member 42 supports the wraparound member 30 in such a way that the central axes 31$c$1, 32$c$1 of the wraparound member 30 lie along the up and down direction. In the present embodiment, the second support member 42 is a tabular member. In the second support member 42 is formed a circular second mating hole 42$h$ into which the second mating portion 32$b$ of the chute 32 is inserted. The second mating hole 42$h$ is formed in such a way that its inner periphery is in a mating relationship with the second mating portion 32$b$ of the chute 32.

(2-4-3) Columnar Members

The columnar members 43 are members that support the second support member 42 above the first support member 41. The columnar members 43 support the first support member 41 and the second support member 42 in such a way that a central axis 41$hcl$ of the first mating hole 41$h$ coincides with a central axis 42$hcl$ of the second mating hole 42$h$. Because of this, the support member 40 supports the former 20 and the wraparound member in such a way that the central axis 22$c$1 coincides with the central axes 31$d$, 32$c$1. In the present embodiment, the columnar members 43 are secured using bolts to the first support member 41 and the second support member 42.

(2-5) Pull-down Belt Mechanisms

The pull-down belt mechanisms 50 suck hold of the packaging material F wrapped around the outer peripheral surface of the second tube member 31 and convey it downward along the length direction of the second tube member 31 (the up and down direction). The pull-down belt mechanisms 50 are disposed on both right and left sides of the second tube member 31 below the former 20. The pull-down belt mechanisms 50 each include a pull-down belt 51, a drive roller 52, and a follower roller 53.

The pull-down belts 51 are belts having a suction function. The pull-down belts 51 bridge the drive rollers 52 and the follower rollers 53, which are disposed a predetermined width apart from each other in the up and down direction. When drive devices (not shown in the drawings) drive the drive rollers 52 and the follower rollers 53, the pull-down belts 51 convey the packaging material F downward while rotating between the drive rollers 52 and the follower rollers 53.

Because the flat first surfaces 31$a$ are formed in the outer peripheral surface of the second tube member 31, the pull-down belts 51 can make contact with the packaging material F in a wider area and can more efficiently convey the packaging material F than in a case where the first surfaces 31$a$ are not formed.

(2-6) Longitudinal Sealing Mechanism

The longitudinal sealing mechanism 60 presses the edges of the packaging material F wrapped around the outer peripheral surface of the second tube member 31 against the second tube member 31 with a fixed pressure along the length direction of the second tube member 31 (the up and down direction) and at the same time applies heat to and seals the edges to thereby form a longitudinal seal (the portion in FIG. 2 indicated by diagonal hatching). The longitudinal sealing mechanism 60 is disposed on the front side of the second tube member 31 below the former 20.

Because the flat second surface 31$b$ is formed in the outer peripheral surface of the second tube member 31, the longitudinal sealing mechanism 60 can make contact with the packaging material F in a wider area and can more efficiently seal the tubular packaging material Fm than in a case where the second surface 31$b$ is not formed.

(2-7) Transverse Sealing Mechanism

The transverse sealing mechanism 70 is a mechanism that seals upper and lower ends of the bags B by sealing the tubular packaging material Fm in the transverse direction. The transverse sealing mechanism 70 is disposed below the second tube member 31. The transverse sealing mechanism 70 has two sealing jaws 71 and drive mechanisms (not shown in the drawings). The sealing jaws 71 have heaters (not shown in the drawings) inside.

The drive mechanisms drive the two sealing jaws 71 to clamp the tubular packaging material Fm from the front and rear directions at a predetermined timing. The sealing jaws 71 seal with the heaters the clamped part of the tubular packaging material Fm.

(3) Operation of Bagmaking and Packaging Machine

The sheet-like packaging material F supplied from the packaging material supply unit to the former 20 is guided along the surface of the collar member 21, folded by the upper end 22*u* of the first tube member 22, and thereafter formed in a tubular shape along the inner peripheral surface of the first tube member 22. The packaging material F formed in a tubular shape by the first tube member 22 passes through a gap G between the inner peripheral surface of the first tube member 22 and the outer peripheral surface of the second tube member 31 and becomes wrapped around the outer periphery of the second tube member 31. The packaging material F wrapped around the outer peripheral surface of the second tube member 31 is conveyed downward along the length direction of the second tube member 31 by the pull-down belt mechanisms 50, and thereafter the longitudinal seal is formed in the packaging material F by the longitudinal sealing mechanism 60.

Meanwhile, the packaging articles A weighed by the weighing machine 2 are sequentially dropped into the opening formed in the upper end 32*au* of the chute 32. The packaging articles A that have been dropped pass through the chute 32 and the second tube member 31 and are discharged from the opening formed in the lower end 31*d* of the second tube member 31. Below the lower end 31*d*, the two sealing jaws 71 precedingly clamp and transversely seal the tubular packaging material Fm to form the upper portion of the bag B and the bottom portion of the following bag B. The packaging articles A discharged from the opening formed in the lower end 31*d* of the second tube member 31 fill the tubular packaging material Fm whose bottom portion has been sealed. Thereafter, the two sealing jaws 71 clamp and transversely seal the tubular packaging material Fm above the space filled with the packaging articles A to thereby form the upper portion of the bag B and the bottom portion of the following bag B.

(4) Assembly of Former and Wraparound Member to Support Member

Figure 10:
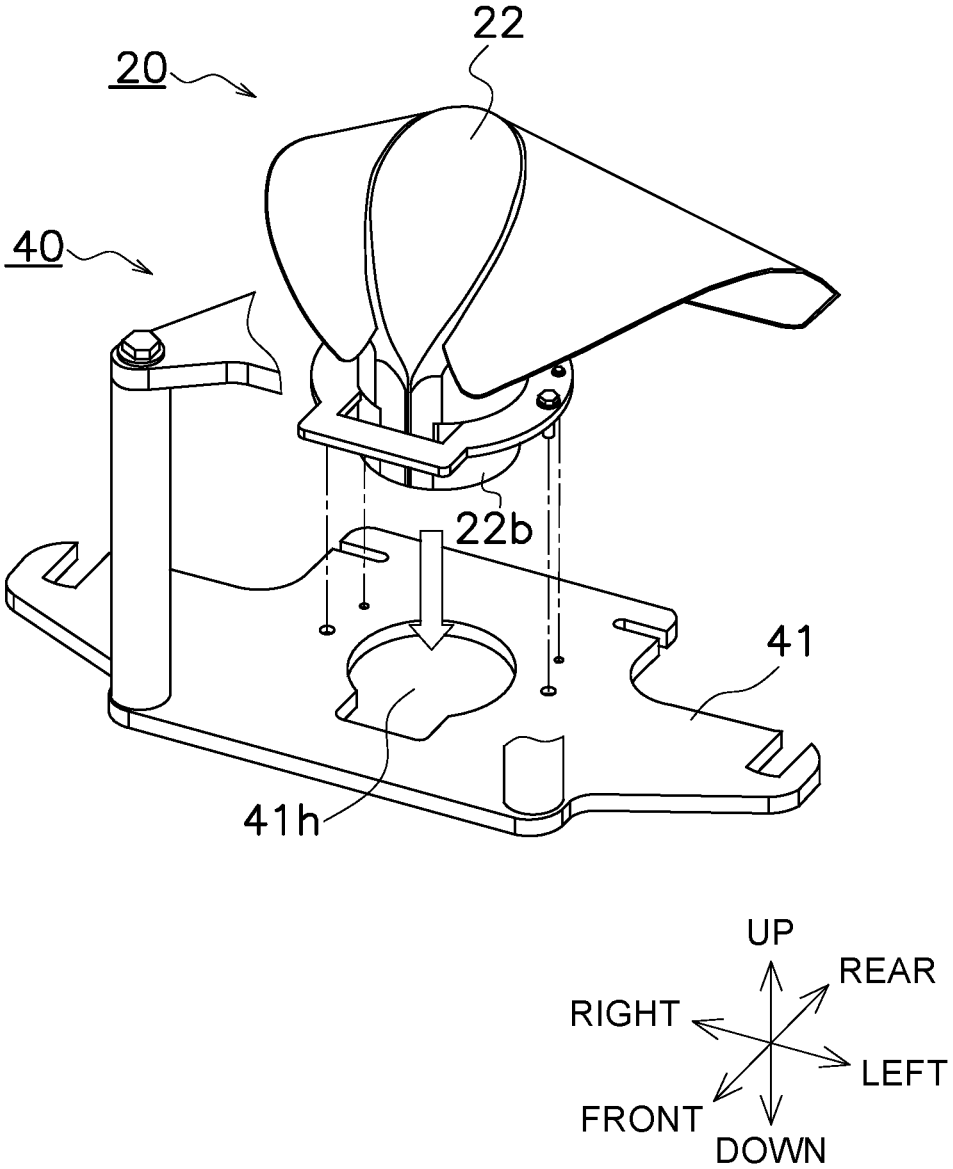
FIG. 10 is a perspective view for describing a procedure for assembling the former and the wraparound member to the support member.
Figure 11:
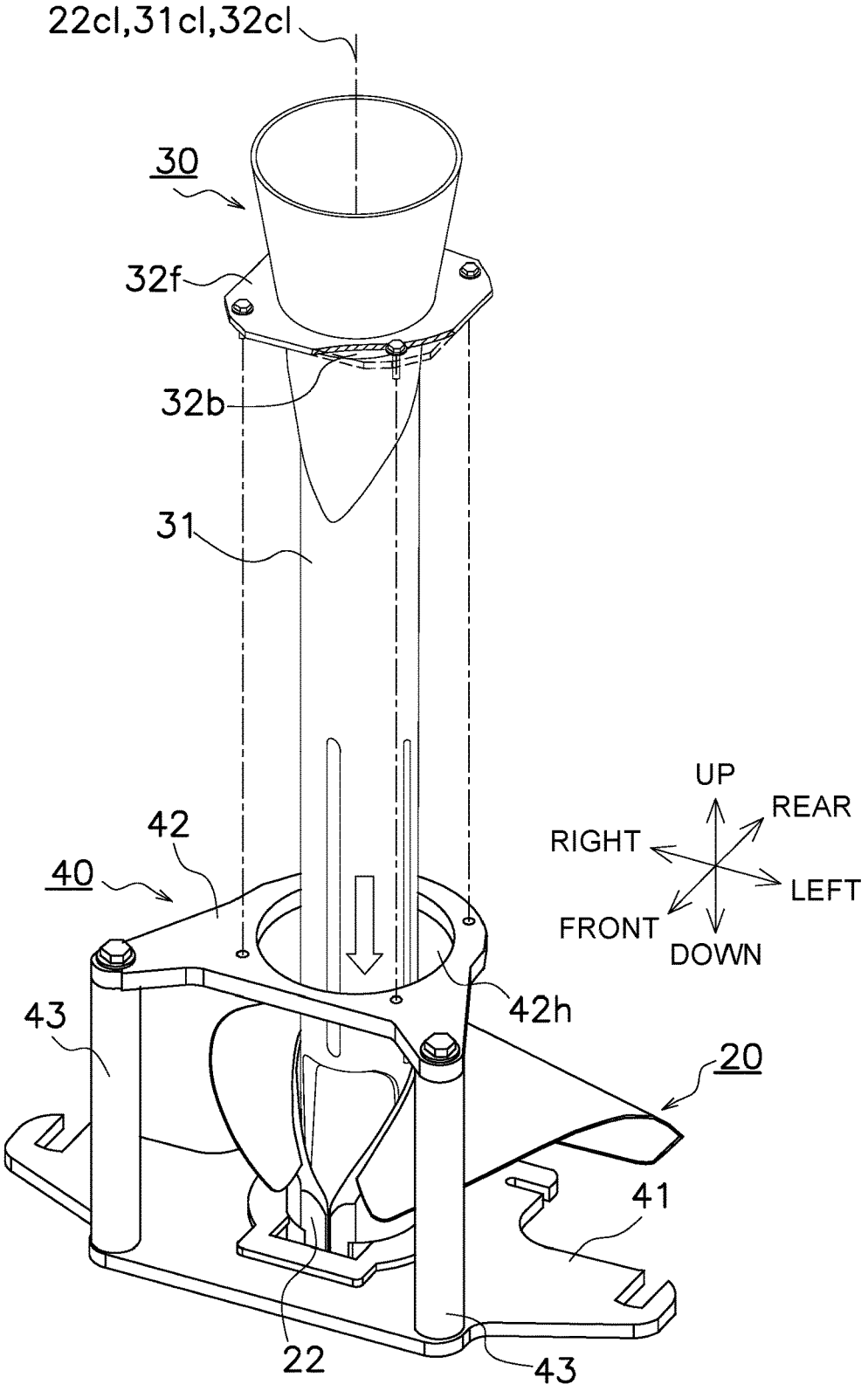
FIG. 11 a perspective view for describing the procedure for assembling the former and the wraparound member to the support member.

FIG. 10 and FIG. 11 are perspective views for describing a procedure for assembling the former 20 and the wraparound member 30 to the support member 40. The assembly of the former 20 and the wraparound member 30 to the support member 40 can be performed by the following procedure. It will be noted that FIG. 10 shows the support member 40 partially transparent (i.e., removed) for clarity. Furthermore, FIG. 11 shows the second flange 32*f* partially transparent for clarity.

First, the first tube member 22 of the former 20 is inserted from above into the first mating hole 41*h* in the first support member 41 so that the first mating portion 22*b* becomes mated with the first mating hole 41*h* (see FIG. 10). Because of this, the former 20 becomes positioned on the support member 40. Thereafter, the first flange 23 is secured to the first support member 41 using bolts.

Next, the second tube member 31 of the wraparound member 30 is inserted from above into, and in the order of, the second mating hole 42*h* in the second support member 42 and the inner periphery of the first tube member 22 (see FIG. 11). When the second tube member 31 is inserted downward to a predetermined position, the second mating portion 32*b* becomes mated with the second mating hole 42*h*. Because of this, the wraparound member becomes positioned on the support member 40. Thereafter, the second flange 32*f* is secured to the second support member 42 using bolts.

As mentioned above, the support member 40 supports the former 20 and the wraparound member 30 in such a way that the central axis 22*c*1 coincides with the central axes 31*c*1, 32*c*1. For this reason, the former 20 and the wraparound member 30 are mutually positioned as a result of the first mating portion 22*b* being mated with the first mating hole 41*h* and the second mating portion 32*b* being mated with the second mating hole 42*h*. Specifically, the central axis 22*c*1 coincides with the central axes 31*c*1, 32*c*1, and the gap G through which the packaging material F passes is formed between the inner peripheral surface of the first tube member 22 and the outer peripheral surface of the second tube member 31, as a result of the first mating portion 22*b* being mated with the first mating hole 41*h* and the second mating portion 32*b* being mated with the second mating hole 42*h*.

(4) Characteristics (4-1)

The former 20 folds and guides the packaging material F. The former 20 includes the collar member 21 that guides the packaging material F and the first tube member 22 for forming in a tubular shape the packaging material F guided by the collar member 21. The first tube member 22 has one end to which the collar member 21 is connected, and includes the first mating portion 22*b*. The bagmaking and packaging machine 100 forms the packaging material F in a tubular shape and packages the packaging articles A. The bagmaking and packaging machine 100 includes the former 20, the wraparound member 30, and the support member 40. Around the wraparound member 30 is wrapped the packaging material F folded by the former 20. The support member 40 supports the former 20 and the wraparound member 30.

The first mating portion 22*b* is mated with the support member 40.

In the bagmaking and packaging machine 100, the former 20 is positioned on the support member 40 by mating. Consequently, by the use of the bagmaking and packaging machine 100, the former 20 is positioned with high precision by simple assembly work.

(4-2)

The wraparound member 30 includes the second tube member 31 and the chute 32. The second tube member 31 is a tubular member around which the packaging material F is wrapped. The chute 32 is a member that guides the packaging articles A to the second tube member 31.

The chute 32 is connected to one end of the second tube member 31 and includes the second mating portion 32*b* that is mated with the support member 40.

In the bagmaking and packaging machine 100, the wraparound member 30 is positioned on the support member 40 by mating. Consequently, by the use of the bagmaking and packaging machine 100, the former 20 and the wraparound member 30 are positioned with high precision by simple assembly work.

(4-3)

The support member 40 includes the first support member 41 and the second support member 42. The first support member 41 supports the former 20. The second support member 42 supports the wraparound member 30.

In the first support member 41 is formed the first mating hole 41*h* with which the first mating portion 22*b* is mated. In the second support member 42 is formed the second mating hole 42*h* with which the second mating portion 32*b* is mated.

The central axis 41*hcl* of the first mating hole 41*h* coincides with the central axis 42*hcl* of the second mating hole 42*h*.

In the bagmaking and packaging machine 100, the central axis 41*hcl* of the first mating hole 41*h* coincides with the central axis 42*hcl* of the second mating hole 42*h*. For this reason, the former 20 and the wraparound member 30 are mutually positioned as a result of the first mating portion 22*b* being mated with the first mating hole 41*h* and the second mating portion 32*b* being mated with the second mating hole 42*h*. Consequently, by the use of the bagmaking and packaging machine 100, the former 20 and the wraparound member 30 are positioned with high precision by simple assembly work.

(4-4)

In the first tube member 22, the cutout portion 22*a* to which is connected the edge of the collar member 21 is formed across the circumferential direction in the upper end surface 22*us*.

In the bagmaking and packaging machine 100, the collar member 21 is positioned by bringing the edge 21*ae*, which defines the notch 21*a*, into abutment with the cutout portion 22*a*. Consequently, by the use of the bagmaking and packaging machine 100, the collar member 21 is positioned on the first tube member 22 with high precision.

(4-5)

The cutout portion 22*a* has the depth D that is greater than the plate thickness t of the collar member 21.

In a case where the edge 21*ae* of the collar member 21 defining the notch 21*a* and the cutout portion 22*a* are connected to each other using welding, sometimes the welded part of the collar member 21, which is a tabular member, deforms and projects slightly outward (in the present embodiment, upward) due to heat during welding. The projecting part formed in this way causes the packaging material F along the collar member 21 to slightly separate from the surface of the collar member 21 in the vicinity of the upper end 22*u* of the first tube member 22 and obstructs normal folding of the packaging material F at the upper end 22*u* of the first collar member 22.

In the bagmaking and packaging machine 100, the depth D of the cutout portion 22*a* is formed greater than the plate thickness t of the collar member 21, so the upper end surface 22*us* of the first tube member 22 is not even with the surface of the collar member 21. The upper end surface 22*us* that is not even with the surface of the collar member 21 can make contact with the packaging material F that has slightly separated from the surface of the collar member 21 as described above, so the packaging material F can be normally folded at the upper end 22*u* of the first tube member 22. Consequently, by the use of the bagmaking and packaging machine 100, the occurrence of problems in the folding of the packaging material F at the upper end 22*u* of the first tube member 22 is inhibited.

(4-6)

A method of manufacturing the bagmaking and packaging machine 100 includes a step of connecting the collar member 21 and the first tube member 22 to each other and thereafter forming the first mating portion 22*b* using cutting.

In the method of manufacturing the bagmaking and packaging machine 100, the first mating portion 22*b* is formed with high precision using cutting, so the former 20 is positioned on the support member 40 with high precision.

(4-7)

The method of manufacturing the bagmaking and packaging machine 100 includes a step of forming the second mating portion 32*b* using cutting.

In the method of manufacturing the bagmaking and packaging machine 100, the second mating portion 32*b* is formed with high precision using cutting, so the wraparound member 30 is positioned on the support member 40 with high precision.

(4-8)

The bagmaking and packaging machine 100 further includes the pull-down belts 51 that convey the packaging material F along the length direction of the second tube member 31. The method of manufacturing the bagmaking and packaging machine 100 includes a step of connecting the second tube member 31 and the chute 32 to each other and thereafter forming the first surfaces 31*a* that oppose the pull-down belts 51 in the outer peripheral surface of the second tube member 31 using cutting.

In the method of manufacturing the bagmaking and packaging machine 100, the first surfaces 31*a* are formed with high precision using cutting.

(4-9)

The bagmaking and packaging machine 100 further includes the longitudinal sealing mechanism 60 that seals the edges of the packaging material F along the length direction of the second tube member 31. The method of manufacturing the bagmaking and packaging machine 100 includes a step of connecting the second tube member 31 and the chute 32 to each other and thereafter forming the second surface 31*b* that opposes the longitudinal sealing mechanism 60 in the outer peripheral surface of the second tube member 31 using cutting.

In the method of manufacturing the bagmaking and packaging machine 100, the second surface 31*b* is formed with high precision using cutting.

(4-10)

The method of manufacturing the bagmaking and packaging machine 100 includes a step of forming the cutout portion 22*a* using cutting.

In the method of manufacturing the bagmaking and packaging machine 100, the cutout portion 22*a* is formed with high precision using cutting. For this reason, deformation is inhibited from occurring in the edge 21*ae* of the collar member 21 during connection to the cutout portion 22*a*.

REFERENCE SIGNS LIST

1 Packaging Machine
2 Weighing Machine
10 Packaging Material Supply Unit
20 Former
21 Collar Member
22 First Tube Member
22*a* Cutout Portion
22*b* First Mating Portion
22*c*1 Central Axis (First Tube Member)
22*us* Upper End Surface
30 Wraparound Member
31 Second Tube Member
31*a* First Surfaces
31*b* Second Surface
31*c*1 Central Axis (Second Tube Member)
32 Chute
32*b* Second Mating Portion
40 Support Member
41 First Support Member
41*h* First Mating Hole

41*hcl* Central Axis (First Mating Hole)
42 Second Support Member
42*h* Second Mating Hole
42*hcl* Central Axis (Second Mating Hole)
50 Pull-down Belt Mechanisms
51 Pull-down Belts
60 Longitudinal Sealing Mechanism
70 Transverse Sealing Mechanism
100 Bagmaking and Packaging Machine
A Packaging Articles
B Bags
D Depth of Cutout Portion
F Packaging Material
Fm Tubular Packaging Material
t Plate Thickness of Collar Member

CITATION LIST

Patent Literature

Patent Literature 1: Japanese Patent Unexamined Publication No. 2012-86874A

The invention claimed is:

1. A bagmaking and packaging machine that forms a packaging material in a tubular shape and packages packaging articles, the bagmaking and packaging machine comprising:

a former that folds and guides a packaging material, the former comprising:

a collar member that guides the packaging material; and a first tube member that forms in a tubular shape the packaging material guided by the collar member, the first tube member having an upper end surface and a cutout portion separated from the upper end surface by a depth that is greater than a thickness of the collar member such that the upper end surface is not even with the surface of the collar member, the first tube member having one end to which the collar member is directly connected, and including a first mating portion, a wraparound member around which the packaging material folded by the former is to be wrapped; and a support member that supports the former and the wraparound member, the first mating portion being mated with the support member.

* * * * *